US005974076A

United States Patent [19]

Brassey

[11] Patent Number: 5,974,076

[45] Date of Patent: Oct. 26, 1999

[54] APPARATUS FOR ACTIVATION OF CARBONACEOUS CHAR OR REACTIVATION OF SPENT CARBON BY ELECTRICAL RESISTANCE HEATING

[76] Inventor: John Michael Brassey, 2 Timberlake Rd. North, Sherman, Conn. 06784

[21] Appl. No.: 09/072,071

[22] Filed: May 4, 1998

Related U.S. Application Data

[63] Continuation-in-part of application No. 09/020,313, Feb. 9, 1998.

[51] Int. Cl.[6] ..... H05B 3/60

[52] U.S. Cl. ..... 373/120; 373/115

[58] Field of Search ..... 373/109–116, 123, 373/120, 130; 202/99, 124; 432/129; 252/420

[56] References Cited

U.S. PATENT DOCUMENTS

| | | | |
|---|---|---|---|
| 1,147,165 | 7/1915 | Hampton | 373/120 |
| 2,270,245 | 1/1942 | Barker | 373/120 |
| 3,346,368 | 10/1967 | Braunwarth et al. | 373/109 |
| 4,001,487 | 1/1977 | Schumacher et al. | 373/115 |
| 4,011,430 | 3/1977 | Witkin et al. | 219/486 |
| 4,261,857 | 4/1981 | Nakao | 252/420 |
| 5,089,457 | 2/1992 | Gaylard et al. | 373/115 |
| 5,377,220 | 12/1994 | Plessis | 373/120 |
| 5,406,582 | 4/1995 | Plessis | 373/115 |
| 5,903,591 | 5/1999 | Brassey | 373/120 |

*Primary Examiner*—Tu Ba Hoang

[57] ABSTRACT

An apparatus for the activation or reactivation of a descending column of carbon in a tubular reactor that consists of two or more sequential sections, each section provided with an steam inlet, a graphite block positioned at its top, means to effect homogenization of the carbon granules, and a separate and independently controlled electric circuit, wherein the descending carbon in each section is channeled to a diameter that is about half of the diameter of the main portion of the vertical tubular reactor, the slope of the constricting channel being about 45°, the lower electrical terminal of the electric circuit serving said section being positioned above or at the upper portion of the homogenizing device.

2 Claims, 2 Drawing Sheets

APPARATUS FOR ACTIVATION OF CARBONACEOUS CHAR OR REACTIVATION OF SPENT CARBON BY ELECTRICAL RESISTANCE HEATING

This application is a continuation-in-part patent application of U.S. patent application Ser. No. 09/020,313 filed Feb. 9, 1998.

1. FIELD OF THE INVENTION

This invention relates to an improved apparatus for the activation of carbonaceous feedstocks or the reactivation of spent activated carbon (both hereinafter referred to as the "carbon" or the "carbon feedstock") by electrical resistance heating in the presence of steam. It particularly relates to an improved apparatus in which the carbon is electrically heated in separate sections in which each section provides both for homogenization of the moving carbon column and for self-contained electrical circuitry.

2. DESCRIPTION OF THE RELATED ART

The use of electrical resistance heating for activation and reactivation of carbon in the presence of steam has been described in U.S. Pat. No. 5,406,582 as well as in U.S. Pat. Nos. 5,089,457, and 5,173,921, and in U.S. patent application Ser. No. 08/784,013, filed Jan. 15, 1997. In the process described in U.S. Pat. No. 5,406,582, the apparatus comprised a tubular reactor that consisted of two or more sequential vertical sections, each section containing a descending column of carbon, with inlets to introduce steam into any one or more of the sections, and wherein the electric current was fed into the column of carbon of each such section via a graphite block serving as an electrode and positioned at the center of the top of the column by attachment to a steel plate that included a flat or a V-shaped shelf and that was provided with openings to allow the released gases and vapors to escape.

In the activation of a carbonaceous char, the steam serves as a chemical reagent that selectively gasifies some of the carbon by converting it to carbon monoxide, and thus creates a large pore volume and extensive surface area. In reactivation of spent activated carbons, the steam serves to remove, or desorb, the matter that the carbon has retained and, to some extent, to develop additional porosity.

Other gases can also be used in place of steam to activate carbon. An example is carbon dioxide, which can also gasify carbon by converting it to carbon monoxide.

In the process and apparatus described in U.S. Pat. No. 5,406,582 the carbon entering each section passes around the centrally positioned graphite electrode. The carbon then flows downward into the next section, the upper portion of such descending carbon forming a cone whose side forms an angle with the horizontal, the so-called "angle of repose," which is defined as the maximum slope or angle at which loose material remains stable.

In the inventions described in the prior art, and in the invention described in U.S. patent application Ser. No. 8/784,013, filed Jan. 15, 1997, the various improvements have been designed to optimize the homogeneous distribution of the electric current through the carbon, the penetration of steam or other gases through the carbon, and the homogenization of the carbon itself.

The various furnace designs described in the aforementioned prior art were directed to the maintenance of a uniform distribution of electric current through the descending carbon, as well as to the repeated homogenization of the carbon granules. These stratagems involved repeated passage of current between various steel parts of the apparatus and portions of the descending carbon granules that were being mixed for homogenization, with passage of current from said carbon granules and said steel parts. The motions that the carbon granules undergo during such mixing processes necessarily involve some physical separations among them, as well as from the aforementioned adjacent steel. As the electric current traverses these small separations or gaps, especially those between carbon and steel, electric arcing occurs. Such arcing is especially detrimental to the steel, resulting in deterioration, or "burning" of the areas of the steel apparatus that are affected.

It is accordingly an object of this invention to provide an improved apparatus for the activation of carbon feedstocks or the reactivation of spent activated carbon by electrical resistance heating in the presence of an activating gas.

It is another object of this invention to provide such improvement when the activating gas is steam or carbon dioxide.

It is another object of this invention to provide such improvement when the carbon granules are repeatedly homogenized as they descend through the reaction tube during the activation or reactivation process.

It is yet another object of this invention to prevent electrical arcing, especially between steel and carbon, that may occur during such process of activation or reactivation of carbon.

SUMMARY OF THE INVENTION

I have discovered an improved means for avoiding electrical arcing, especially between steel and carbon granules, during the activation or reactivation of carbon feedstocks (including spent activated carbon) by electrical resistance heating in the presence of an activating gas.

Briefly, the object of this invention is achieved by improvements in an apparatus that utilizes a feed hopper from which the carbon feedstock enters by gravity into a vertical tubular reactor of refractory material, whose top is joined to the bottom of the feed hopper, and whose bottom is joined to a valve or other means for removal of the activated or reactivated carbon product, the reactor consisting of two or more vertical sequential sections, a descending column of carbon feedstock moving through such sections, with the means to introduce steam into each of said sections, and with the means to effect homogenization of the carbon granules as they pass from section to section, wherein the electric current is fed into the column of descending carbon feedstock via graphite blocks serving as electrodes and suitably attached and positioned at the top of each such section, each section being provided with an opening to allow the released gases and vapors to escape. The improvements in the apparatus consist in providing a separate and independently controlled electric circuit for each section, the upper terminal of each of which is a graphite electrode positioned at the top of each said section, and in channeling the descending carbon in each section to a diameter that is about half of the diameter of the main portion of the vertical tubular reactor, the slope of the constricting channel being in the range of about 25° to about 75°, preferably about 45°, the constricted descending carbon column then entering into a suitable device for homogenizing the carbon granules, the lower electrical terminal of the electric circuit serving said section being positioned above or at the upper portion of such device. The homogenized carbon granules then fall freely into the top of the next section below, where they come in contact with the graphite electrode which also serves as the upper electrical terminal of the said lower section. The carbon granules in the main portion of each section of the tubular reactor, including the constricting portion, flow through the homogenizing device and then fall into the section below where they meet the graphite electrode at the upper part of said lower section. In the apparatus of my invention, the separate circuit in each section progresses from its power source to the graphite electrode for that section, through the descending carbon granules in that section, to a steel conductor positioned above or at the upper portion of the homogenizing device which is at the lower end of said section, and finally back to the other terminal of the power source. In that portion of said electrical circuit between the graphite electrode at the upper portion of each such section and the steel conductor just above the homogenizing device below, the carbon granules are in continuous contact with each other, and there is no physical separation between carbon granules, and particularly no physical separation between carbon granules and any steel portion of the electrical circuit, that would promote arcing between carbon and steel. In a preferred embodiment of my invention, the steel conductor positioned just above the homogenizing device of each section takes the form of a shallow steel conical ring that serves as the transition between the aforementioned constricting channel above it and the homogenizing device below, and that is in electrical contact with the other terminal of the power supply for that section. The conical angle of said ring should be such as to provide continuous smooth flow of the descending carbon granules downward from the aforementioned constricting channel, and for this purpose its angle is preferably equal or reasonably close to that of said channel. Said steel conical ring provides convenient contact to complete the electrical circuit without necessarily involving making electrical contact directly with the homogenizing device, should such contacting be undesirable or inconvenient. The passage of the descending carbon through the homogenizing device necessarily involves some separation among carbon granules and between such granules and the homogenizing device, which is generally made of steel or has steel components. Since these portions of the apparatus of my invention are not part of any electrical circuit, no arcing is possible. However, the carbon would ordinarily lose heat when it is not supplied with electrical or other energy. Such heat loss results from the energy consumption in the desorption of adsorbed matter from spent carbon, from endothermic chemical reactions that occur in the activation process, and from heat losses by transfer to the outside through the insulation and to the internal flowing gasses. The consequent drops in temperature are likely to be detrimental to the desired activation or reactivation processes. It is to this problem that the aforementioned channeling of the descending carbon in each such section to a diameter that is less than about half of the diameter of the main portion of the vertical tubular reactor, with a slope of the constricting channel of about 45°, is addressed. The decreased cross-sectional area of the descending column of carbon granules causes an increase in its electrical resistance, and I have found that this and other factors, such as differences in heat losses, combine to increase the temperature of the descending carbon as the tube diameter is constricted. I have found that the increase in carbon temperature resulting from the aforementioned decrease in diameter to about half of its maximum dimension, over a distance established by about a 45° slope, satisfactorily compensates for the temperature loss occasioned by the absence of electrical current during the carbon homogenization and free fall between sections. It will be obvious to one skilled in the art that such compensation can be adjusted by changes in the extent and slope of the cross-sectional constriction to match the heat loss that would otherwise be suffered in such transfers.

BRIEF DESCRIPTION OF THE DRAWINGS

The invention will be more clearly understood with reference to the drawings in which.

DESCRIPTION OF THE PREFERRED EMBODIMENTS

In the preferred embodiments, the carbon feedstock is fed into three to five sequential vertical sections, as will be made clearer by reference to the accompanying drawing, which is a partly diagrammatic and partly vertical section of the apparatus.

Figure 1:
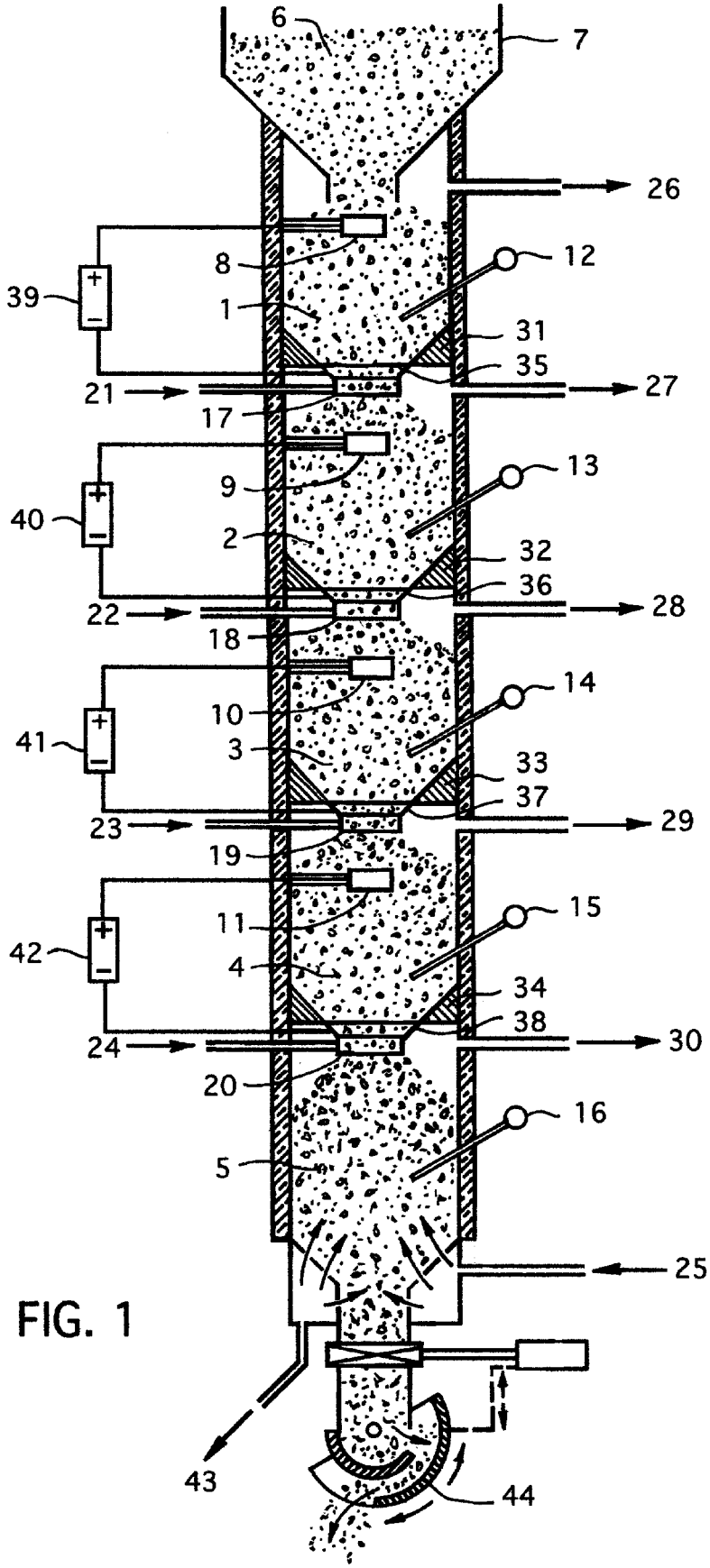
FIG. 1 shows an apparatus for use in the drying and activation or reactivation of carbon by electrical resistance heating according to the process of my invention.
Figure 2:
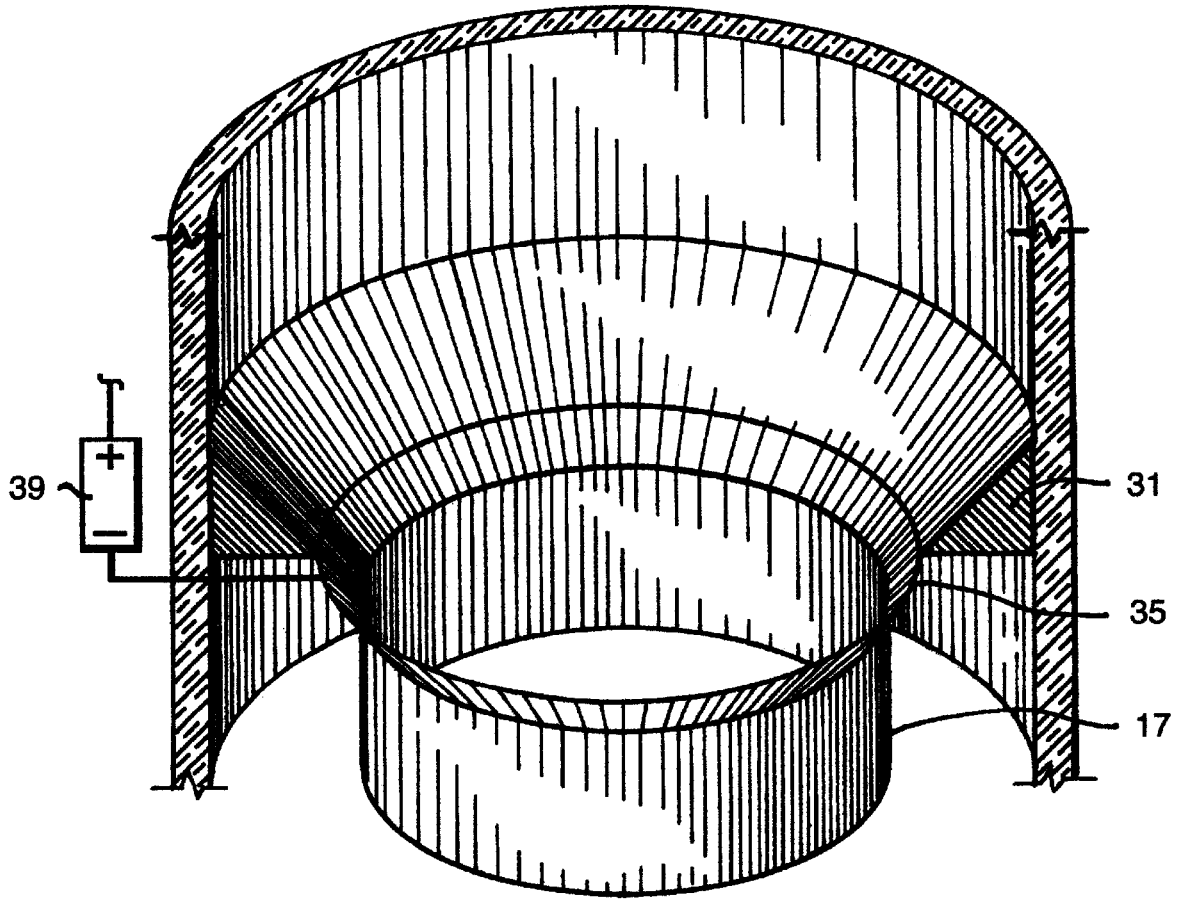
FIG. 2 is a drawing of the shallow steel conical ring that serves as the transition between the constricting channel above it and the homogenizing device below, and that is in electrical contact with the power supply for its section.

As shown in FIG. 1, the carbon is fed into the tubular reactor that consists of five sections, numbered 1, 2, 3, 4, and 5. If the carbon is wet, the top section 1 is a preheating and, if necessary, a drying section. The bottom section 5 serves mainly as a cooling section. The carbon 6 is loaded into a steel feed hopper 7, from which it descends into the first section 1. Introduction of electric current into the carbon is initiated from graphite electrode 8. Similarly, graphite electrodes 9, 10, and 11 serve sections 2, 3, and 4, respectively. Thermocouple 12 measures the temperature of the carbon in section 1. Similarly, thermocouples 13, 14, 15 and 16 serve sections 2, 3, 4, and 5, respectively. As the carbon descends from section 1, it passes through a homogenizing device 17. Similarly, homogenizing devices 18, 19, and 20 serve sections 2, 3, and 4, respectively. Steam is introduced into the carbon in section 1 through steam inlet 21. Similarly, steam inlets 22, 23, 24, and 25 serve sections 2, 3, 4, and 5, respectively. Steam at about 100° C. injected through the said steam inlets is superheated by the hot carbon and homogenizing device which it meets. Particularly, steam entering inlet 25 serves as a coolant for the descending carbon before it emerges from the apparatus. Excess steam, desorbed gases, and gaseous reactions products leave the tubular reactor via various exit tubes above each section, and are shown in FIG. 1 as numbers 26, 27, 28, 29, and 30. Constricting cone 31, which is made of a non-conducting refractory material, channels the carbon in section 1 to a reduced diameter as it enters homogenizing device 17. Similarly, cones 32, 33, and 34 serve sections 2, 3, and 4, respectively. Just below cone 31 and just above and in contact with homogenizing device 17 lies a shallow steel conical ring 35 that serves as the transition for the descending carbon between the aforementioned constricting channel above it and the homogenizing device 17 below. FIG. 2 shows a perspective view of conical ring 35 and its relationship to the constricting cone 31 above and the homogenizing device 17 below. Similarly, shallow steel conical rings 36, 37, and 38 serve sections 2, 3, and 4, respectively. Conical ring 35 serves as the other electrode to complete the electric circuit serving section 1 by making contact with power supply 39. Similarly, power supplies 40, 41, and 42 serve sections 2, 3, and 4 respectively. Tube 43 serves as a drain to remove condensed steam. The discharge of the apparatus is controlled by discharge system 44, as described in U.S. Pat. No. 5,406,582 and other prior art, and fed into any suitable receiving container, such as a steel drum.

It is evident to anyone skilled in the art that various modifications of the apparatus can be made to satisfy various reaction conditions, feedstocks, and desired properties of the activated or reactivated carbon, without changing the basic nature or inventiveness of my disclosure. For example, the number of sections can be reduced to two, or increased to six or more. The various refractory cones that restrict the cross-sectional areas of the descending carbon can selected to provide angles greater or less than 45°, as needed to provide the temperature increases that match the losses suffered while the carbon loses heat during its descent between sections. Similarly, the steel plates that lie just below the refractory cones can be made more or less shallow, as needed to carry the current to the power supply by a route that prevents any electrical arcing between the descending carbon and any steel portion of the apparatus.

My invention will be made clearer by the following examples. These examples are given for illustration only, and are not considered to be limiting.

EXAMPLE 1

A charge of coconut shell char, which constitutes a feedstock for the production of activated carbon, was introduced into the feed hopper 5 of the apparatus shown in the drawing. The inside diameter of the tubular reactor was 22 inches, and the height of each section was 36 inches. The temperature in section 1, which served to preheat the feedstock, was kept at about 750 to about 900° C. The temperature in sections 2, 3, and 4, where most of the activation occurs, was kept in the range of about 900 to 1000° C., and steam was injected into the inlets 21, 22, 23, and 24 at a total rate of about 60 kg/hour. Current in each circuit was maintained between about 100 and about 150 amperes, which required between about 80 and about 110 volts for each power supply. When the carbon was removed from the apparatus through discharge system 44 at a rate of about 50 kg of product per hour, I found that the Iodine Number (A.S.T.M. Standard Test Method D 4607) of various samples ranged from about 900 to about 1100, and that the Carbon Tetrachloride Activity (A.S.T.M. Standard Test Method D 3467) ranged from about 59 to about 65. These values are characteristic of an activated carbon that is suitable for a wide diversity of commercial applications.

EXAMPLE 2

A charge of a wood-based activated carbon that had been exhausted (saturated) by exposure to commercial kitchen exhaust vapors was introduced into the feed hopper 5, shown in the drawing. The temperature in reaction section 1, which served mainly as a drying section was kept at about 750 to about 900° C., while the temperatures in sections 2, 4, and 4 were kept at about 900 to about 1000° C. by appropriate flow of electric current in those individual sectional circuits. Steam was injected into inlets 21, 22, 23, and 24 at a total rate of about 100 kg/hour. Current in each circuit was maintained between about 80 and about 100 amperes, which required between about 50 and about 100 volts for each power supply. As the carbon was discharged from the apparatus at a rate of about 100 kg of product per hour, I found that the Iodine Number (A.S.T.M. Standard Test Method D 4607) ranged from about 950 to about 1000, and that the Carbon Tetrachloride Activity (A.S.T.M. Standard Test Method D 3467) ranged from about 55 to about 65. These values are characteristic of a well reactivated carbon, suitable for a wide diversity of commercial applications.

EXAMPLE 3

A charge of a coal-based activated carbon that had been exhausted (saturated) by exposure to a stream of water contaminated with gasoline was introduced into the feed hopper 3. The temperature in reaction section 1, which served mainly as a drying section was kept at about 750 to about 900° C., while the temperatures in sections 2, 4, and 4 were kept at about 900 to about 1000° C. Steam was injected into inlets 21, 22, 23, and 24 at a total rate of about 100 kg/hour. Current in each circuit was maintained between about 90 and about 120 amperes, which required between about 60 and about 110 volts for each power supply. As the carbon was discharged from the apparatus at a rate of about 100 kg of product per hour, I found that the Iodine Number (A.S.T.M. Standard Test Method D 4607) ranged from about 900 to about 950, and that the Carbon Tetrachloride Activity (A.S.T.M. Standard Test Method D 3467) ranged from about 50 to about 60. These values are characteristic of a suitably reactivated carbon, useful for a wide diversity of commercial applications.

I claim:

1. An apparatus for the activation of a carbon feedstock or the reactivation of spent carbon by electrical resistance heating in the presence of steam, comprising a feed hopper from which the carbon feedstock enters by gravity into a tubular reactor of refractory material to form a descending column of carbon feedstock, wherein the top of the reactor is joined to the bottom of the feed hopper, and wherein the bottom of the reactor is joined to means for removal of the activated or reactivated carbon feedstock, said reactor consisting of at least two sequential vertical sections, wherein each of said sections is provided with an upper graphite electrode serving to introduce current for providing electrical resistance heating into the descending carbon feedstock near an upper portion of said each of said sections, a lower electrode is provided at a lower portion of said each of said sections, and inlets to introduce steam into each of said sections, the lower portion of each of said sections is provided with homogenizing means for homogenizing the carbon feedstock as it descends between said sections, said electrodes forming an independent electric circuit for each of said sections, and wherein both a lower electrical terminal of the electric circuit connected to said lower electrode and said lower electrode are positioned above said homogenizing means, said lower electrode takes the form of a shallow steel conical ring, and said lower portion of each of said sections is reduced to about half of the diameter of the tubular reactor to form a constriction with the slope of said constriction being about 25° to about 75°.

2. An apparatus according to claim 1 in which the conical angle of said steel conical ring is equal to the angle that defined by said slope of said constriction.

* * * * *